US006726305B2

(12) United States Patent
Dietel et al.

(10) Patent No.: US 6,726,305 B2
(45) Date of Patent: Apr. 27, 2004

(54) METHOD AND DEVICE FOR FILLING AN INK SUPPLY SYSTEM IN AN INKJET PRINTER

(75) Inventors: Klaus Dietel, Ulm (DE); Berthold Löw, Erbach (DE); Gerhard Lohrmann, Elchingen (DE); Henning Frunder, Holzheim (DE)

(73) Assignee: Tally Computer Drucker GmbH, Elchingen (DE)

( * ) Notice: Subject to any disclaimer, the term of this patent is extended or adjusted under 35 U.S.C. 154(b) by 0 days.

(21) Appl. No.: 10/085,171

(22) Filed: Feb. 27, 2002

(65) Prior Publication Data

US 2002/0118261 A1 Aug. 29, 2002

(30) Foreign Application Priority Data

Feb. 28, 2001 (DE) ..... 101 09 761

(51) Int. Cl.[7] ..... B41J 2/165

(52) U.S. Cl. ..... 347/30; 347/29; 347/86; 347/92

(58) Field of Search ..... 347/22, 23, 24, 347/29, 30, 32, 85, 86, 92

(56) References Cited

U.S. PATENT DOCUMENTS 5,126,766 A * 6/1992 Terasawa et al. ..... 347/30
5,946,015 A * 8/1999 Courtney ..... 347/92

FOREIGN PATENT DOCUMENTS

JP 361016864 A * 1/1986 ..... 347/93

* cited by examiner

*Primary Examiner*—Shih-Wen Hsieh
(74) *Attorney, Agent, or Firm*—Horst M. Kasper

(57) ABSTRACT

The device for the filling of the ink supply system in an inkjet printer with a nozzle printhead, and ink storage container, and a printhead tank connected to the ink storage container or connectable to the ink storage container disposed on the printhead carriage, furthermore with a cleaning station, wherein the nozzle printhead is sealingly movable to the cleaning station and an exhaust pump connected to the cleaning station, resolves the object of the present invention by having the nozzle printhead with the nozzle inputs placeable at the cleaning station and the nozzle inputs connected to a first nozzle printhead tank part chamber, wherein the first nozzle printhead tank part chamber is separated from a second printhead tank part chamber adjoining to the first printhead tank part chamber.

23 Claims, 2 Drawing Sheets

METHOD AND DEVICE FOR FILLING AN INK SUPPLY SYSTEM IN AN INKJET PRINTER

BACKGROUND OF THE INVENTION

1. Field of the Invention

The invention relates to a method and a device for filling of an inkjet supply system in an inkjet printer, wherein the nozzle printhead is fed by an ink storage container and/ or a nozzle printhead tank connectable to the ink storage container and wherein the nozzle printhead is connected to a cleaning station with an exhaust pump for cleaning purposes.

2. Brief Description of the Background of the Invention Including Prior Art

The nozzle print head comprises essentially an arrangement of a plurality of fine nozzles (with a diameter of several micrometers), wherein likewise fine ink droplets are ejected from the fine nozzles resulting in a print picture and wherein the fine nozzles are controlled by electrical pulses. The nozzles are supplied with ink by the relatively small nozzle printhead tank disposed near the nozzle printhead. The nozzle printhead tank is connected to the ink supply system comprising the ink storage container and the ink feed lines through a connecting sleeve. A very fine meshed sieve is furnished in the nozzle printhead tank, wherein the very fine meshed sieve protects the nozzles against dirt particles and air bubbles, since these upon their penetration into the nozzles would interfere with the printing.

Upon putting the inkjet printer into service and upon change of the ink storage container, air passes into the ink supply system. Nevertheless the nozzle printhead tank has to be filled with ink.

The sieve disposed in the nozzle printhead tank prevents however that under standard conditions the air disposed at that location can escape through the nozzles. In this phase a sufficient filling of the nozzle printhead tank is not possible. However the nozzle printhead tank has to be continuously filled with a minimal amount of ink in order to be able to maintain a sufficient ink flow to the nozzles in case of intensive printing. It is necessary for this purpose that a large part of the sieve face is covered with ink. For the case that the sieve is predominantly covered by air, then the air blocks a too large part of this sieve for the ink flow and the nozzle function is interrupted. This situation is also not remedied by generating a high under pressure at the nozzles with the aid of the suction pump through the cleaning station. The suction process leads only to the situation that depending on the already present degree of filling of the nozzle printhead tank, predominantly ink is being suctioned of, which ink can press by at the sieve under the high under pressure. As soon as again a smaller under pressure prevails at the nozzles, and then air blocks again partially the ink flow and interrupts thereby again the nozzle function.

It is an object of the present invention to feed the nozzle printhead tank with an ink amount substantially corresponding to the volume of the nozzle printhead tank.

These and other objects and advantages of the present invention will become evident from the description which follows.

BRIEF DESCRIPTION OF THE INVENTION

The present invention provides that the set object is resolved by having the ink, which ink in general is mixed with air, disposed in a two part subdivided nozzle printhead tank, wherein the part chambers of the printhead nozzle tank are separated by a fine meshed sieve, exhausted off through the nozzles in the time period until a reduced air bubble is formed in the chamber in front of the nozzle inputs. A large amount of ink is thereby stored relative to the volume, wherein a special effect is generated, which special effect was determined by experiments. It proves to be very important that at least a small air bubble is disposed in the nozzle printhead tank. High accelerations, concussions, shocks, then oscillations occur in ink jet printers with high printing speed doing printing and based on the back and forth moving of the printhead's carriage, which high accelerations, concussions, shocks and oscillations can lead to pressure variations in the ink supply system up to the nozzle printhead. It has been shown that already a reduced air bubble in the nozzle printhead tank is sufficient to damp these pressure variations such that no interferences occur in the nozzles. Such interferences therefore are avoided by having the air bubble small relative to the overall volume of the nozzle printhead tank and the desired uniform ink flow to the nozzles occurs. Upon replacement of the ink volume in the first part chamber, the second part chamber is freed from the thereby penetrating air just to such an extent that that the ink flow to the nozzle head is not interfered with, however an air bubble remains in the second part chamber in order for the interferences, which are entered into the ink supply by moving of the nozzle head on the print carriage, to be effectively kept away from the nozzles and thereby not interfering with the nozzle function.

According to further steps it is furnished that a valve disposed in the ink supply line to the nozzle printhead is closed, that thereafter a high under pressure is generated over the exhaust pump in the cleaning station with closely placed nozzle printhead, such that upon reaching of a predetermined under pressure high level the valve is opened and thereupon the exhaust pump is turned off. During generation of the under pressure, the under pressure is not only generated in the cleaning station, but also between cleaning station and nozzle printhead in the nozzle region and in the nozzle printhead tank. The closed valve does not permit an inflow of ink from the ink supply container. The air bubble present in the nozzle printhead extends in this phase in analogy to the gas laws more and more. The expansion can however occur only through this sieve and through the nozzles in the direction toward the pump, since the rearward nozzle region is blocked by the ink and by the valve. As soon as a predetermined under pressure (depending on the exhaust time, the sealing of the connection between the cleaning station and the nozzle region, the power of the pump) prevails, then the valve is opened. Upon opening suddenly ink can continually flow from the supply region. The under pressure in the ink supply system collapses and the air bubble shrinks again corresponding to the standard pressure. The volume released in the printhead tank is filled by the continually flowing ink and the ink level in the printhead tank rises to a higher level. The air already passed through the sieve and the nozzles does not again return into the printhead tank. This process effects that the printhead tank is filled to a large extent with ink, however the residual air bubble remains corresponding to the pressure situations. Therewith the recited requirements for a substantial filling of the printhead tank and the generation of a residual air bubble are fulfilled.

Alternatively one can now proceed after further steps in such a way that a valve, which is connected to the storage container generates a high under pressure in an exhaust line from the suction region or from the cleaning station such that after a predetermined under pressure height level, the valve is opened and thereafter the exhaust pump is turned off. Several advantages are thereby achieved, which in part are also advantageous relative to the device technology. A reduction of the mass to be carried along on the printhead's carriage is achieved in addition to the substantial filling of the printhead tank and the formation of the air bubble.

The device for the filling of the ink supply system in an inkjet printer with a nozzle printhead, and ink storage container, and a printhead tank connected to the ink storage container or connectable to the ink storage container disposed on the printhead carriage, furthermore with a cleaning station, wherein the nozzle printhead is sealingly movable to the cleaning station and an exhaust pump connected to the cleaning station, resolves the object of the present invention by having the nozzle printhead with the nozzle inputs placeable at the cleaning station and the nozzle inputs connected to a first nozzle printhead tank part chamber, wherein the first nozzle printhead tank part chamber is separated from a second printhead tank part chamber adjoining to the first printhead tank part chamber. The advantage is the substantial filling of the nozzle printhead tank part chambers while simultaneously forming an air bubble of a predetermined size, which air bubble serves for damping the printhead's carriage motions, that is of the accelerating and delaying forces.

Further features to serve for the arrangement of device components advantageous for the performance of the method. An electrical, pneumatic, or mechanical controllable valve is disposed in the ink supply line between the first printhead tank part chamber or the second printhead tank part chamber and the ink storage container.

The valve can also be disposed close to the cleaning station.

Another variation results from having a storage container as a buffer volume disposed between the valve and the suction pump. The valve is closed after sealingly placing the nozzle printhead at the cleaning station and a high under pressure is generated in the buffer volume with the exhaust pump. Upon opening of the valve after reaching of the high under pressure and after switching off of the exhaust pump, the generated air bubble expands quickly, which however can occur only through the sieve and through the nozzles in the direction of the exhaust pump. The rearward path is blocked by continual flowing ink. The under pressure collapses and the air bubble shrinks to a measure corresponding to standard pressure. The volume in the print head tank part chambers is filled by continual flowing ink. The buffer volume is associated with the advantage that the generated under pressure does not collapse too quickly after opening of the valve.

It is proposed according to further features to furnish a branching in the ink supply line between the valve and the exhaust pump, wherein the storage container for the buffer volume is connected to the branching. The valve does not have to be disposed here on the printhead carriage. The mass disposed on the printhead carriage is thereby reduced and the acceleration and delaying forces are smaller.

An improvement further comprises that the exhaust line itself forms the buffer volume by the longitudinal section increased in its diameter and or its length.

Embodiments of the invention are illustrated in the wall in which are explained in more detail in the following and by way of which also the method is illustrated.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
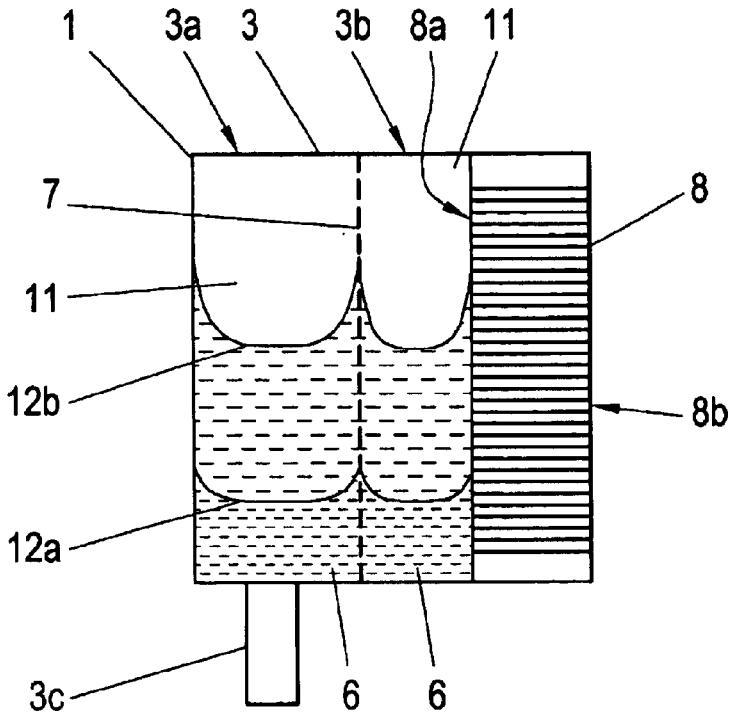
FIG. 1 is a view of a vertical section through the printhead tank part chambers with the nozzle region.

The method for filling of the ink supply system in an inkjet printer is performed such that ink 6 containing air bubbles is exhausted in a nozzle printhead tank 3 divided into two parts, wherein the part chambers 3*a* and 3*b* are separated by a fine meshed sieve 7, in a time section through the nozzles 8 until a reduced, small air bubble 11 forms in the space in front of the nozzle inputs 8*a* (FIG. 1), wherein the nozzle printhead 1 of the inkjet printer is fed from the ink storage container 2 and a nozzle printhead tank 3 connectable to the ink storage container 2 and wherein the ink storage container 2 is connected to a cleaning station 4 with an exhaust pump 5 for cleaning purposes.

Initially a valve 9 in an ink supply line 10 to the nozzle printhead 1 is closed for generating of a high under pressure, wherein thereafter a high under pressure is generated in the ink supply system through the exhaust pump 5 in the cleaning station 4 while the nozzle printhead 1 is placed sealingly adjacent. Upon reaching of a predetermined under pressure height level, the valve 9 is opened and thereafter exhaust pump 5 is switched off.

Upon placing the ink jet printer in operation and upon change of the ink storage container 2, air passes into the ink supply system, if the nozzle printhead tank 3 is to be filled with ink 6. The sieve 7 disposed in the nozzle printhead 1 prevents however that under standard conditions the there initially disposed air can escape through the nozzles 8. No sufficient filling of the nozzle printhead 1 is accomplished here. The printhead tank 3 has to be filled with a minimum amount of ink in order to be able to maintain a sufficient ink flow to the nozzles 8 in case of intensive printing. It is necessary for this purpose that a large part of the sieve 7 is covered by ink 6. In case the sieve 7 is covered predominantly with air, then the air blocks a large part of the surface of the sieve 7 for the ink flow and the printing can be interrupted at least in a part of the nozzles 8. This situation is also not relieved by having suctioning at the nozzles 8 with rising under pressure with the aid of the exhaust pump 5 through the cleaning station 4. The suctioning leads only to the situation that predominantly ink is suctioned off depending on the already reached filling level of the printhead tank 3, wherein the ink then can press past the air bubble 11 at the sieve 7 at the higher under pressure. In case of a smaller suction pressure at the nozzles 8, for example during printing, the air bubble 11 partially blocks the ink flow. It has been shown to be very important that a small air bubble 11 permanently is present in the printhead tank 3. High acceleration forces, delaying forces, concussions, shocks and oscillations occur during printing in printers with a high print speed, which high acceleration forces, delaying forces, concussions, shocks and oscillations can lead to pressure variations in the supply system up to the nozzle printhead 1. It has been shown in experiments that already a small air bubble 11 in the print head tank 3 is sufficient to dampen these pressure variations such that they do not lead to interferences in the nozzles 8. In case that this small air bubble 11 would become smaller and smaller in the course of a longer time period, there would be generated an increased susceptibility to interferences of the printing system.

An (electrically, mechanically, pneumatically) controllable valve 9 is inserted into the ink supply line 10 to the nozzle printhead 1.

For filling of the printhead tank 3 one proceeds as follows:

The nozzle printhead 1 is moved in front of the cleaning station 4 in a sealing position, the valve 9 is closed through the control line 9*a*, the exhaust pump 5 is switched on, the high under pressure is generated, then the valve 9 is opened and the exhaust pump 5 is turned off. The following effects are resulting thereby: the under pressure is generated not only in the cleaning station 4 but also in the nozzle printhead 1 and in the printhead tank part chambers 3*a* and 3*b*. The closed valve 9 does not allow continual flow of ink 6 from the ink storage container 2. The air bubble 11 present in the nozzle printhead 1 thereby extends corresponding to the gas laws more and more. The expansion can however only occur through the sieve 7 and the nozzles 8 in the direction of the exhaust pump 5, since the realward path through the ink 6 and the valve 9 is blocked. As soon as a predetermined under pressure has been reached (depending on the power of the exhaust pump 5, the sealing of the connection (nozzle printhead 1/exhaust pump 5), duration of the exhausting), then the valve 9 is opened.

Suddenly ink 6 can flow continually from the ink storage container 2 through the connection sleeve 3*c*. The under pressure in the system collapses and the air bubble 11 shrinks again corresponding to the standard pressure. The volume becoming free in the printhead tank 3 is filled by the continually flowing ink 6 and the ink level in the printhead tank 3 rises from a level 12*a* to a level 12*b*. The air already passed to this sieve 7 and the nozzles 8 does not again return into the printhead tank 3. This results in that printhead tank 3 is filled to a large part with ink 6, however an air bubble 11 remains in residual form corresponding to the pressure situations.

Figure 2:
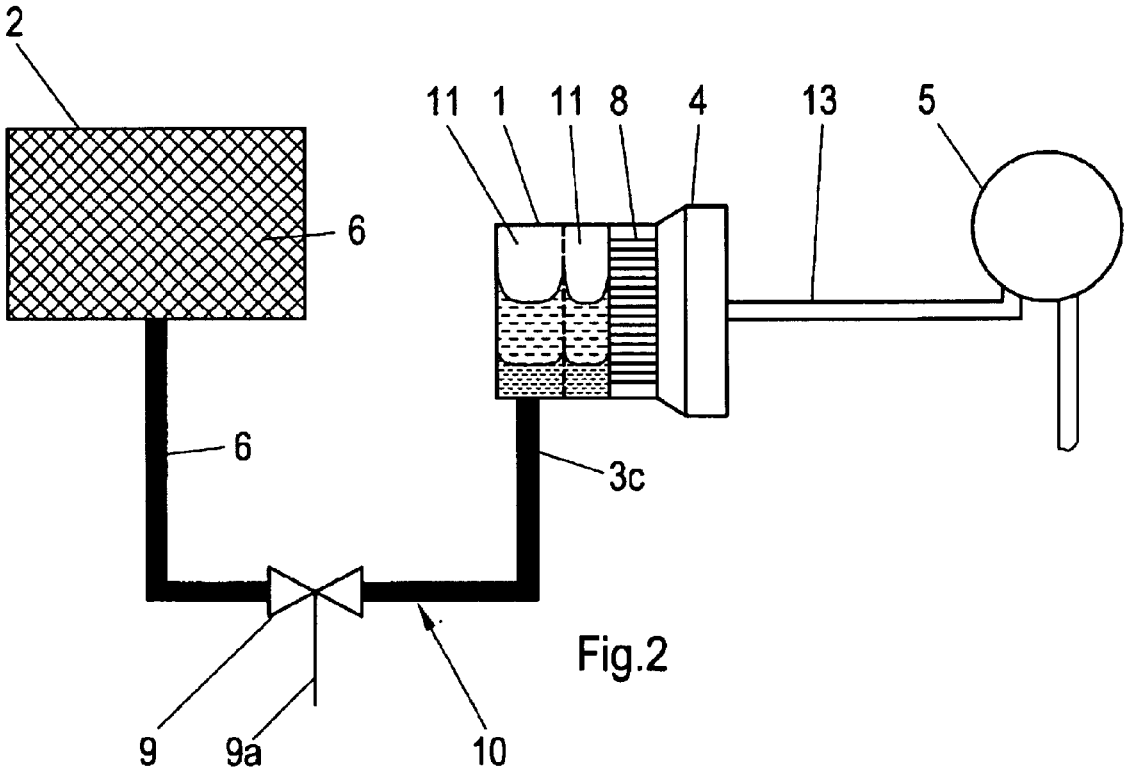
FIG. 2 is a viewof the ink supply system in a block diagram with ink supply container, valve, printhead tank part chambers, nozzles, cleaning station and exhaust pump.
Figure 3:
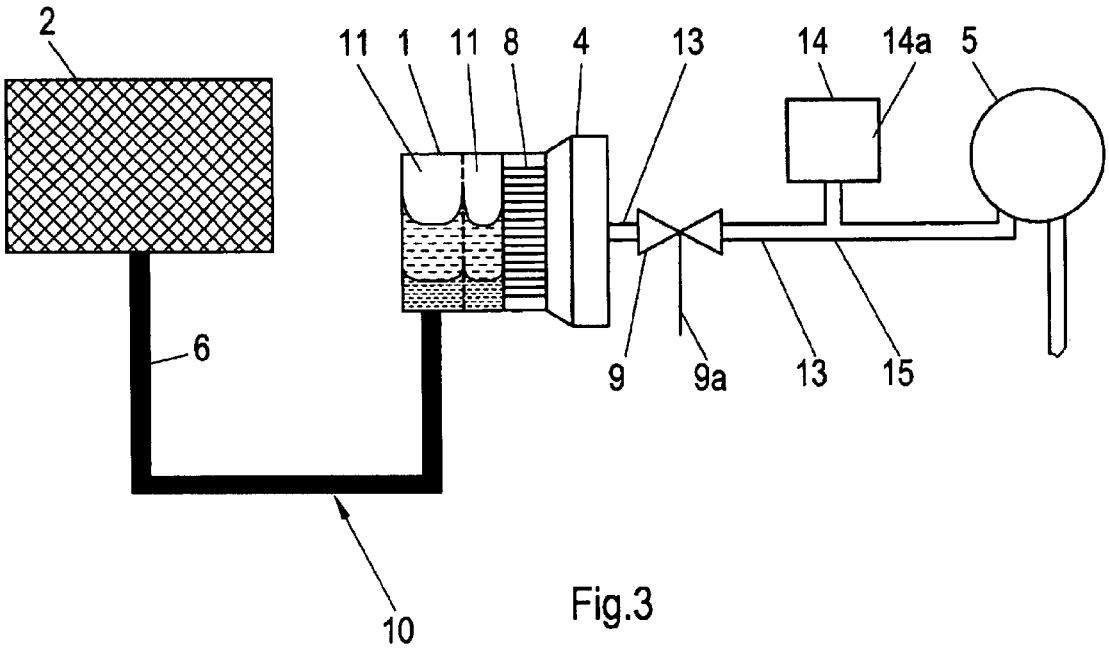
FIG. 3 is a view of an alternative construction of the ink supply system.
Figure 4:
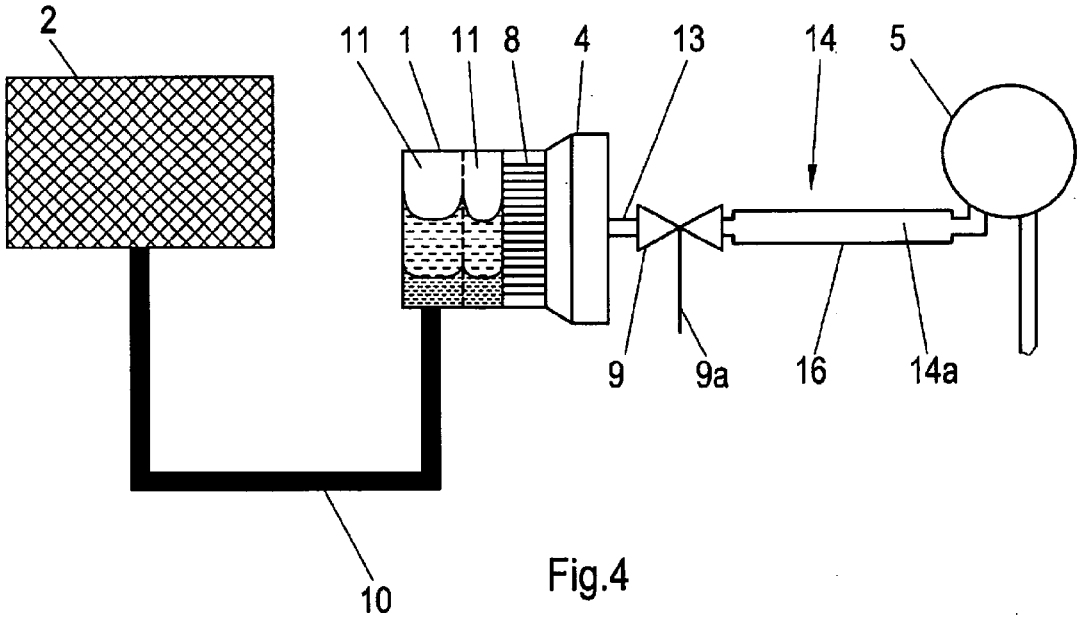
FIG. 4 is a view of a further alternative embodiment of the ink supply system.

In general a control line 9*a* is employed according to FIG. 2 in order to control the valve 9. This control line 9*a* and the valve 9 are carried along with the print head carriage. In contrast these components can be disposed in the fixed part of the ink jet printer according to FIG. 3. A controllable valve 9 and the storage container 14 is inserted into the exhaust line 13 between the cleaning station for and the exhaust pump 5 as a buffer volume. The valve 9 should be disposed as close as possible to the cleaning station 4, the storage space 14 should disposed between the valve 9 and the exhaust pump 5, and more in the neighborhood of the valve 9. Two variations are presented for the storage space 14: according to FIG. 3 a branching 15 is furnished in the exhaust line 13, wherein the storage space 14 is connected to the exhaust line 13. The exhaust line 13 can however also be provided between the exhaust pump 5 and the valve 9 by a correspondingly increased diameter and a suitable length as a longitudinal section 16 for furnishing the storage container 14 according to FIG. 4. The effects induced thereby are those which already have been described above. The storage space 14 disposed between the exhaust pump 5 and the valve 9 serves the purpose that the generated under pressure does not collapse too quickly after opening of the valve 9. The under pressure disposed between the exhaust pump 5 and the valve 9 has to be distributed to the complete region of the cleaning station 4, the nozzles 8 and the two printhead tank part chambers 3*a* and 3*b*. The buffer volume 14*a* cannot be too small in comparison to be recited requirements after a sufficient filling of the nozzle printhead 1 and the formation of the air bubble 11 in residual form for the reason that for a short time a sufficient under pressure arrives also in the printhead tank 3, which under pressure causes the air present in the printhead tank 3 to forcefully expand.

It will be understood that each of the elements described above, or two or more together, may also find a useful application in other types of printing system configurations and ink processing procedures differing from the types described above.

While the invention has been illustrated and described as embodied in the context of a method and device for filling an ink supply system in an inkjet printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claim:

1. A method for filling of an ink supply system in an ink jet printer, wherein a nozzle printhead (1) is supplied with ink from an ink storage container (2) and/or a nozzle printhead tank (3) connectable to the ink storage container (2) and wherein a cleaning station (4) with exhaust pump (5) is connected to a nozzle printhead (1) for cleaning purposes, wherein ink, which in general is mixed with air in the nozzle printhead tank subdivided into a first printhead part chamber (3*a*) and a second printhead part chamber (3*b*), wherein the first printhead part chamber and the second printhead part chamber of the nozzle printhead tank are separated by a fine meshed sieve, is suctioned off through nozzles in a time section until a reduced air bubble forms in a space in front of nozzle inputs.

2. The method according to claim 1 wherein a valve (9) is disposed in an ink supply line (10) to the first printhead part chamber (3*a*), wherein thereupon a high under pressure is generated in the ink supply system through the exhaust pump in the cleaning station, which cleaning station is sealingly placed adjacent to the nozzle printhead, wherein upon reaching of a predetermined under pressure height level, the valve is opened and thereupon the exhaust pump is turned off.

3. The method according to claim 1, wherein a valve (9) is connected to a storage container (14), wherein a high under pressure is generated in an exhaust line (13) from a suction region or from the cleaning station, wherein the valve is opened after a predetermined under pressure height level has been reached and wherein thereupon the exhaust pump is turned off.

4. A device for filling of an ink supply system in an ink jet printer with a nozzle printhead (1) having nozzle inputs (8*a*) and having nozzle outputs (8*b*), an ink storage container (2) and a print head tank (3) connectable to the ink storage container or connected to the ink storage container and disposed on the printhead carriage, a cleaning station (4) wherein the nozzle printhead can be moved sealingly adjacent to the cleaning station and wherein an exhaust pump (5) is connected to the cleaning station though an exhaust line (13), wherein the nozzle printhead (1) with the nozzle outputs (8*b*) is disposed adjacent to the cleaning station (4) and wherein a nozzle input (8*a*) is connected to a second printhead part chamber (3*b*), wherein a first printhead part chamber (3*a*) is separated by a sieve (7) from the second printhead part chamber (3*b*) disposed adjacent to the first printhead part chamber (3*a*).

5. The device according to claim 4 wherein an electrically, pneumatically, or mechanically controllable valve (9) is disposed in an ink supply line (10) between the first printhead part chamber (3*a*) or the second printhead part chamber (3*b*) and the ink storage container (2).

6. The device according to claim 4 wherein an electrically, pneumatically, or mechanically controllable valve (9) is disposed in the exhaust line (13).

7. The device according to claim 6 wherein the valve (9) is disposed closely to the cleaning station (4).

8. The device according to claim 6 further comprising:

a storage container (14) is disposed between the valve (9) and the exhaust pump (5) as a buffer volume (14*a*).

9. The device according to claim 8 wherein a branching (15) is furnished in the exhaust line (13) between the valve (9) and the exhaust pump (5), wherein the storage container (14) for the buffer volume (14*a*) is connected to the branching (15).

10. The device according to claim 6 wherein the exhaust line (13) forms the buffer volume (14*a*) by a longitudinal section (16) having an increased diameter and/or an increased length.

11. A method for filling of an ink supply system in an ink jet printer comprising the following steps:

supplying a nozzle printhead (1) by an ink storage container (2) and/or a nozzle printhead tank (3) connectable to the ink storage container;

furnishing a nozzle printhead tank divided into a first printhead part chamber (3*a*) and a second printhead pan chamber (3*b*);

connecting a cleaning station (4) with exhaust pump (5) to the second printhead part chamber for cleaning purposes;

employing a fine meshed sieve (7) for separating the first printhead part chamber and the second printhead part chamber of the nozzle printhead tank;

suctioning off ink, which in general is mixed with air in the nozzle printhead tank, through the nozzles in a time section until a reduced air bubble forms in a space in front of nozzle inputs (8*a*).

12. The method according to claim 11 further comprising:

disposing a valve (9) in an ink supply line (10) to the nozzle printhead;

generating thereupon a high under pressure in the ink supply system through the exhaust pump in the cleaning station which is sealingly placed adjacent to the nozzle printhead;

opening the valve upon reaching of a predetermined under pressure height level; and turning off the exhaust pump thereupon.

13. The method according to claim 11 further comprising:

connecting a valve (9) to a storage container (14);

generating a high under pressure in an exhaust line (13) from a suction region or from the cleaning station;

opening the valve after a predetermined under pressure height level has been reached; and thereupon turning off the exhaust pump.

14. The method according to claim 11 further comprising:

freeing the second printhead part chamber (3*b*) from the thereby penetrating air just to such an extent that the ink flow to the nozzle head is not interfered with, however an air bubble remains in the second part chamber in order for the interferences, which are entered into the ink supply by moving of the nozzle head on the print carriage, to be effectively kept away from the nozzles and thereby not interfering with the nozzle function.

15. A device for filling of an ink supply system in an ink jet printer comprising:

a printhead carriage;

a nozzle printhead (1) having nozzle inputs (8*a*) and nozzle outputs (8*b*);

an ink storage container (2);

a print head tank (3) having a first printhead part chamber (3*a*) and having a second printhead part chamber (3*b*) disposed adjacent to the first printhead part chamber (3*a*) and connectable to the ink storage container or connected to the ink storage container and disposed on the printhead carriage;

a cleaning station (4) wherein the nozzle printhead can be moved sealingly adjacent to the cleaning station;

an exhaust pump (5) connected to the cleaning station through an exhaust line (13), wherein the nozzle printhead (1) with the nozzle outputs (8*b*) is disposed adjacent to the cleaning station (4) and wherein the nozzle inputs (8*a*) are connected to the second printhead part chamber (3*b*);

a sieve (7) separating the first printhead part chamber (3*a*) from the second printhead part chamber (3*b*).

16. The device according to claim 15 further comprising:

an electrically, pneumatically, or mechanically controllable valve (9) disposed in the ink supply line (10) between the first printhead tank part chamber (3*a*) or the second printhead tank part chamber (3*b*) and the ink storage container (2).

17. The device according to claim 15 further comprising:

an electrically, pneumatically, or mechanically controllable valve (9) disposed in the exhaust line (13).

18. The device according to claim 17 wherein the valve (9) is disposed closely to the cleaning station (4).

19. The device according to claim 17 further comprising a storage container (14) is disposed between the valve (9) and the exhaust pump (5) as a buffer volume (14*a*).

20. The device according to claim 19 further comprising:

a branching (15) furnished in the line (13) between the valve (9) and the exhaust pump (5), wherein the storage container (14) for the buffer volume (14*a*) is connected to the branching (15).

21. The device according to claim 19 wherein the exhaust line (13) forms the buffer volume (14*a*) by a longitudinal section (16) having an increased diameter and/or an increased length.

22. A method for filling of an ink supply system in an ink jet printer comprising the following steps:

supplying ink from an ink storage container (2) to a first printhead part chamber (3*a*);

employing a fine meshed sieve (7) for separating the first printhead part chamber from a second printhead part chamber (3*b*);

connecting nozzles to the second printhead part chamber;

connecting a cleaning station (4) with exhaust pump (5) to the second printhead part chamber for cleaning purposes;

suctioning off ink, which in general comes mixed with air from the ink storage container, through the nozzles in a time section until a reduced air bubble forms in a space of the second printhead part chamber in front of nozzle inputs.

23. A device for filling of an ink supply system in an ink jet printer comprising:

a printhead carriage;

an ink storage container (2) mounted on the printhead carriage;

a nozzle printhead (1) having nozzle inputs (8*a*) and nozzle outputs (8*b*);

a first printhead part chamber (3*a*) of the print head (1) is connected to the ink storage container (2);

a second printhead part chamber (3*b*) of the print head (1) is disposed adjacent to the first printhead part chamber (3*a*);

a fine sieve (7) separating the first printhead part chamber (3*a*) from the second printhead part chamber (3*b*);

ink nozzles (8) having nozzle inputs (8*a*) and nozzle outputs (8*b*), wherein the nozzle inputs (8*a*) are connected to the second printhead part chamber (3*b*);

a cleaning station (4) sealingly disposable adjacent to the nozzle outputs (8*b*);

an exhaust line (13) connected to the cleaning station (4);

an exhaust pump (5) connected to the cleaning station (4) through the exhaust line (13).

* * * * *